United States Patent [19]

Wilhelm

[11] Patent Number: 4,499,617

[45] Date of Patent: Feb. 19, 1985

[54] WATER CLOSET MODIFICATIONS

[76] Inventor: John R. Wilhelm, 11605 Split Rail Ct., Rockville, Md. 20852

[21] Appl. No.: 542,571

[22] Filed: Oct. 19, 1983

Related U.S. Application Data

[63] Continuation of Ser. No. 267,713, May 28, 1981, abandoned.

[51] Int. Cl.[3] ..... E03D 11/10

[52] U.S. Cl. ..... 4/441; 4/424

[58] Field of Search ..... 4/324, 325, 415, 424, 4/441, DIG. 3; 251/309

[56] References Cited

U.S. PATENT DOCUMENTS

| | | | |
|---|---|---|---|
| 3,719,958 | 3/1973 | Wilhelm | 4/424 |
| 3,802,457 | 4/1974 | Wurzburger | 251/309 |
| 3,903,550 | 9/1975 | Wilhelm | 4/424 X |
| 4,262,880 | 4/1981 | Danko et al. | 251/309 X |

*Primary Examiner*—Charles E. Phillips

*Attorney, Agent, or Firm*—Shapiro and Shapiro

[57] ABSTRACT

An insertable weir structure for a water closet includes a cylindrical valve, with an opening thru the cylinder perpendicular to and passing thru its axis; rotatable and externally controlled such that in one position it permits the liquid wastes to pass thru a passageway in the weir of the water closet and when rotated approximately 90° completely closes the passageway in the weir forcing flushed material to follow the conventional path over the top of the weir.

10 Claims, 7 Drawing Figures

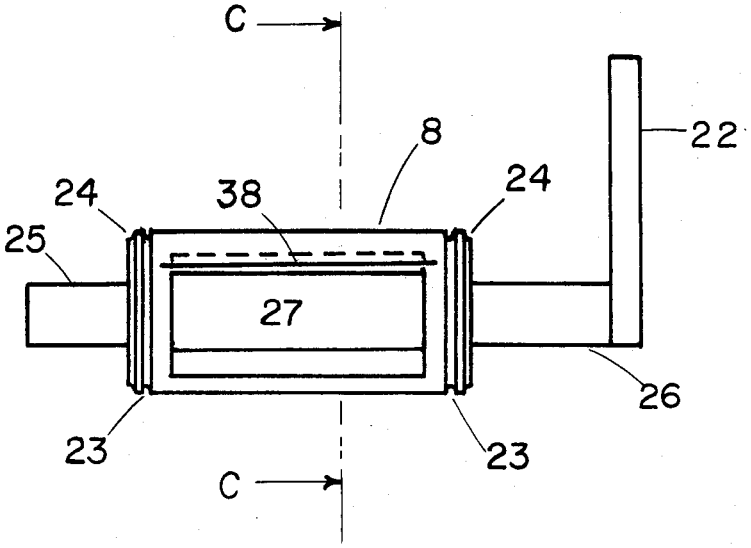
FIG. IV
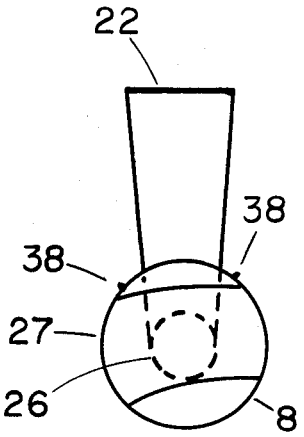
FIG. IV CC

WATER CLOSET MODIFICATIONS

This is a continuation application of Ser. No. 267,713, filed May 28, 1981, now abandoned.

There are now three patents registered in the U.S. Patent Office which relate to a low water use water closet which has as its central feature a valve in the weir of the commode. An externally controlled valve closure mechanism is controlled by the flushing operation of one of two tank flushing handles being accomplished thru a bicycle hand brake type cable connecting the two mechanisms. The valve mechanism which opens and closes the opening in the weir of these patents is a pad of soft waterproof material being rotated into and out of contact with the opening in the weir. It is the object of this invention to define a different type of mechanism which will perform the same function but in a more efficient manner. The concept of a commode flushed by a tank having a partial as well as a full flush capability is thoroughly disclosed in several earlier patents including mine and is not repeated in this disclosure. An appropriate utilization with a dual flush capability tank is assumed. The external operation of the valve in this disclosure is represented simply as a handle.

In FIG. I I show a representaton of a conventional commode which has been modified to include the improvement of the invention. The tank has been omitted having no significance in the understanding of this disclosure.

FIG. II is an elevation view of the portion of the trap area where the ceramic weir is normally found with FIG. II AA being a sectional view of the same area rotated 90° and viewed from the side away from the commode bowl.

FIG. III shows a side view of the insertable weir with FIG. III BB being an exploded view of the insertable weir rotated 90°.

FIG. IV shows the valve element which operates within the insertable weir when inserted therein with FIG. IV CC being a sectional view of the valve taken perpendicular to its axis.

Figure 1:
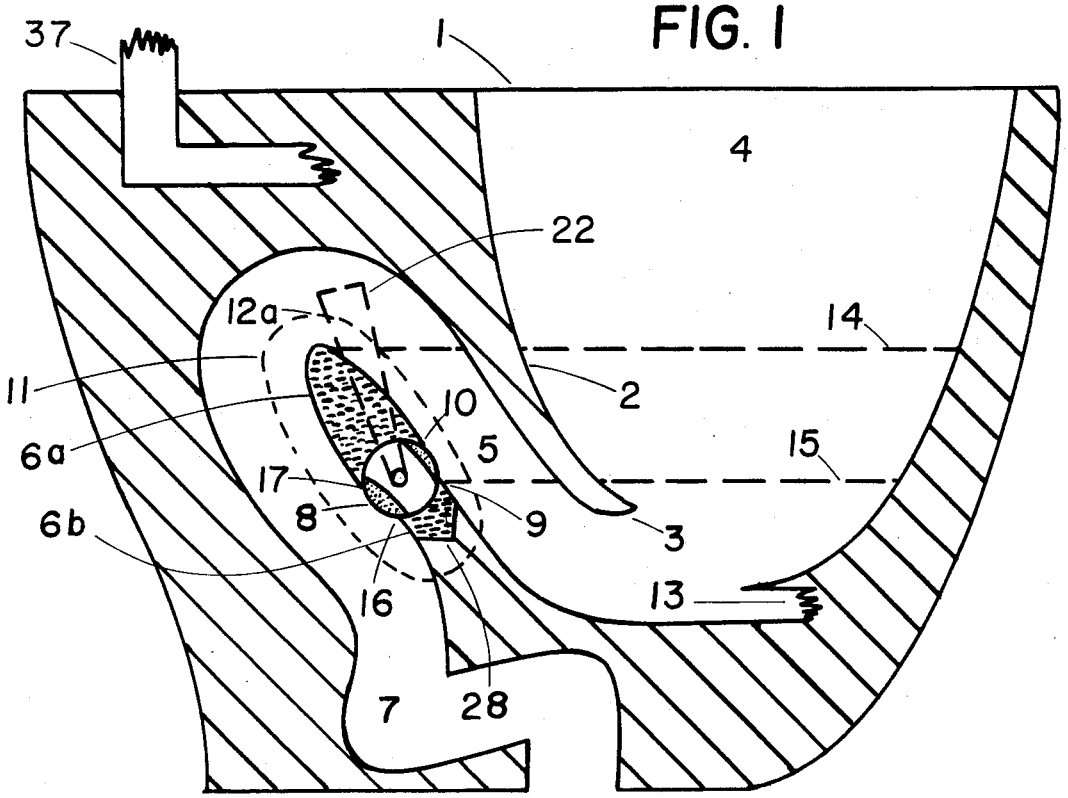
Figure 11A:
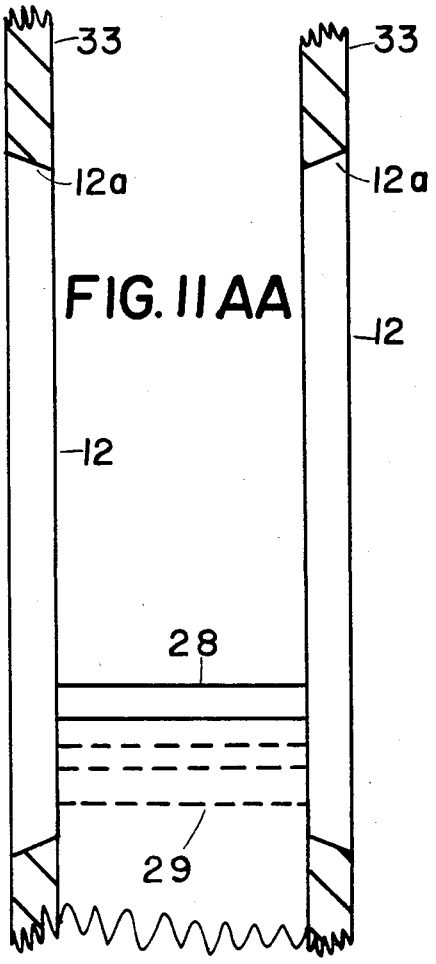
Figure 11:
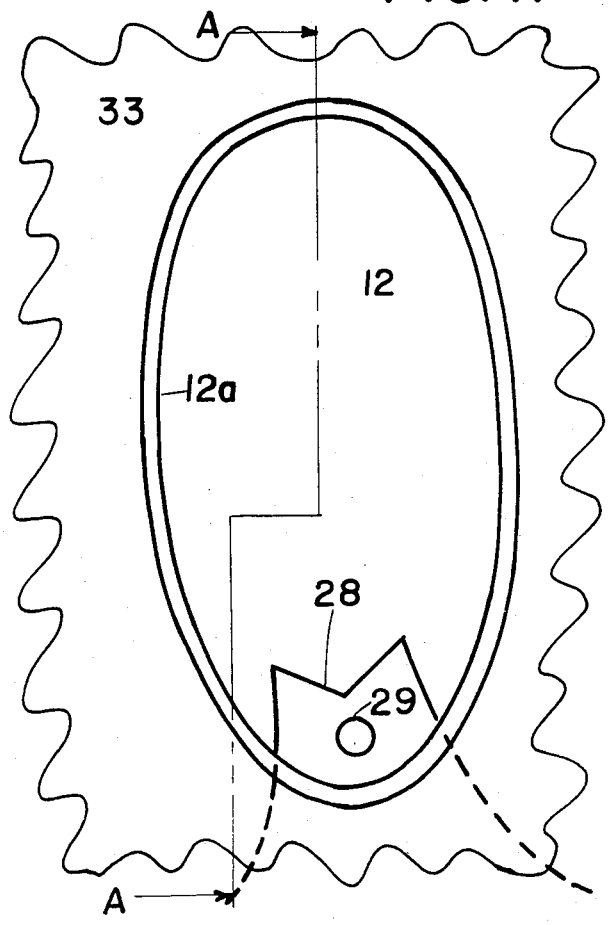
Figure 111B:
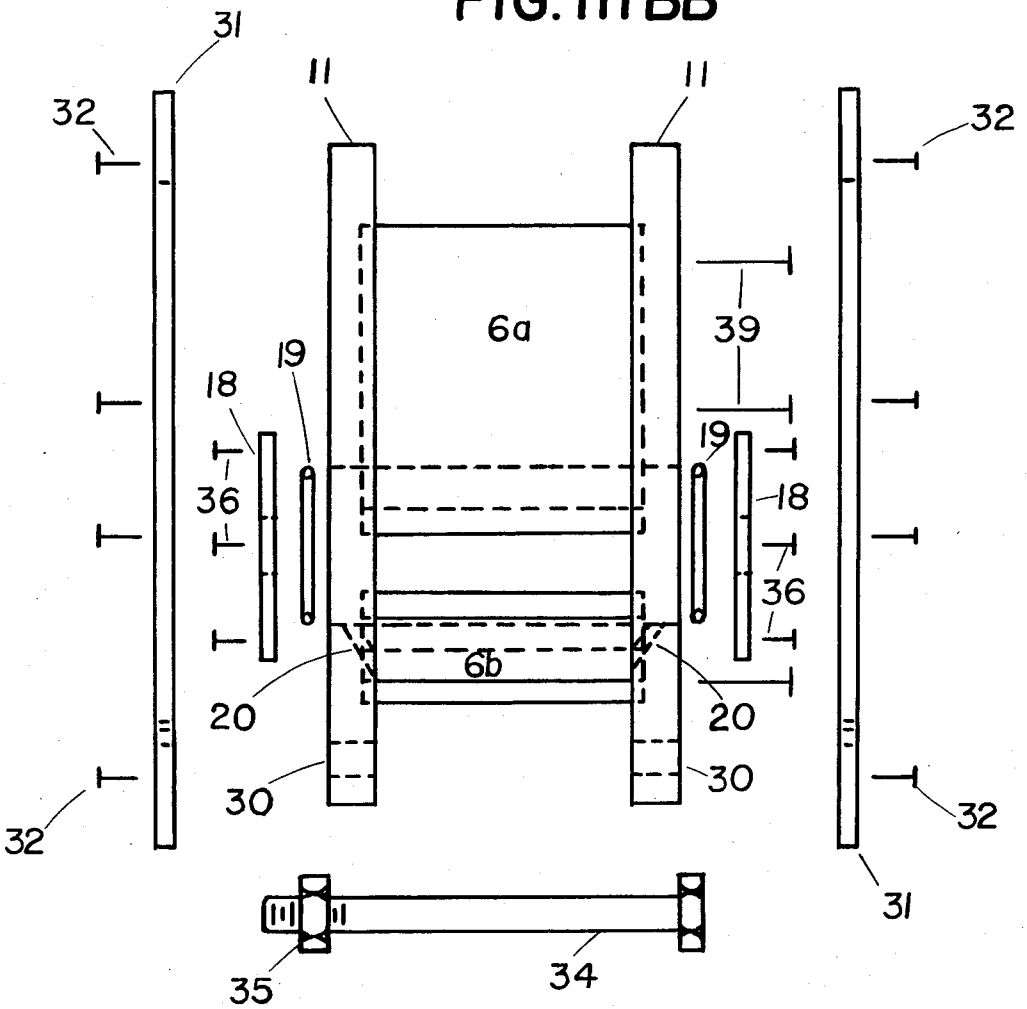
Figure 111:
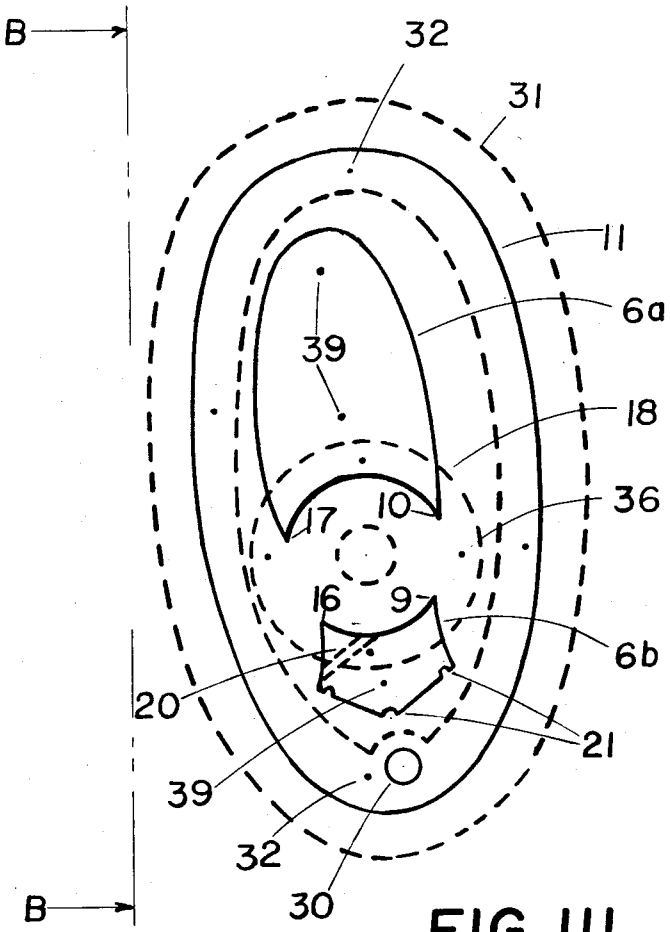

Returning to FIG. I I show the conventional features of a commercially available water closet 1 having a bowl rear wall 2, the lower extremity of the bowl rear wall 3, the bowl 4, and the water trap 5. Additional elements of the water closet include the sewer access volume 7, the primary water entrance 13, tank connection 37, the traditional water level in the bowl 14, and a lower water level in the bowl. As shown in FIG. 1, water trap 5 interconnects bowl 4 and sewer access volume 7. Referring to FIGS. II, & IIAA these figures show the two side walls 33 of the water trap 5. It will thus be appreciated that the water trap 5 is formed by the bowl rear wall 2, the side walls 33 and a trap wall including a first (fixed weir) portion 28 integral with the water closet 1 and a second (insertable weir) portion, to be more fully described, which includes partition members **6*a* and 6*b* and valve means 8. The first and second portions of the trap wall together constitute a weir. Referring again to FIGS. II and IIAA it will be seen that each of the side walls 33 contains an opening or hole 12 which has a beveled edge 12*a* to accommodate the insertion of a caulking or gasket material during assembly to assure water tightness. The internal fixed weir portion 28 protrudes above the limits of openings 12 and contains a bolt hole 29** thru it which is used in the permanent installation of the insertable weir.

In FIG. III I show the details of the insertable weir portion which includes upper partition member **6*a* and lower partition member 6*b*, both of which are attached to side plates 11. One side plate is permanently attached to the two sections of the insertable portion 6*a* and 6*b*. The other side plate is attached during assembly in the water closet 1 held together by side plate screws 39. When assembled and in position on the ceramic fixed weir portion 28 it is held firmly in position by bolt 34 and nut 35 which passes thru the bolt holes 30 in the side plates 11 and bolt hole 29 in the ceramic fixed weir portion 28. Sealing channels 21 which pass thru the side plates 11 and the lower portion of the partition member 6*b* accept the insertion of caulking material to assure a seal between the ceramic fixed portion and the insertable portion of the total weir. The sealing channels 21 are not shown in FIG. III BB for the sake of clarity. 9 and 10 respectively identify the lower and upper edges of the entry opening the passageway of the weir while 16 and 17** respectively identify the lower and upper edges of the exit opening of the passageway.

FIG. III BB is an exploded view of the insertable weir portion rotated 90° shown in a partially assembled state outside of the trap area of the commode. This view shows teflon "O" rings 19 which are held in position by end cover plates 18. These end cover plates also restrain the cylindrical valve member 8 in its proper place when it is installed in the weir. These end cover plates are attached to the side plates 11 by the end cover plate screws 36. Weir restraint rings 31 are permanently fastened to the side plates 11 by weir restraint ring screws 32 and hold the insertable weir portion in position as well as compress the gasket material which is placed between the periphery 11 and the beveled edge of the opening in the ceramic trap side walls **12*a*. Both FIG. III and FIG. III BB show drain tunnels 20 which drain any leakage around the ends of valve member 8** to the sewer access volume.

Viewing FIGS. IV and IV CC together I show the cylindrical valve member 8 with its opening or flow path 27. FIG. IV only shows an a circumferential drain groove 23 near each end of the cylinder which channels any leakage that might take place into the drain tunnels 20. It also shows the recesses 24 for the "O" rings 19 which together form the rotating seal for the valve, as well as linear seals 38 which inhibit air passage around valve member 8 during the siphoning action associated with defecation flushings. Neither the drain grooves 23 nor the "O" ring recesses 24 are shown in FIG. IV CC for the sake of clarity. The cylindrical valve member 8 is supported on one end by a shaft member 25 and on the other end by another shaft member 26 which is caused to rotate by handle 22.

The functions and interactions of these various elements are best understood by reviewing an operational cycle during a urine disposal and then a disposal of fecal material. The cylindrical valve member 8 housed in the insertable weir portion between partition members **6*a* and 6*b* is continuously urged into a closed position by an appropriate spring action which is not shown in this disclosure. Therefore the weir in a normal condition is a continuous surface without interruption to its full height. The water level in bowl 4 is usually at the lower level 15 being determined by the position of the lower edge of the valve entry opening 9 each time the valve 8 is opened for urine disposal and closed on completion of the urine flush cycle. Since a much smaller amount of water is in the bowl to be contaminated, it requires far less flush water to dispose of it. Rotating valve member 8 to the open position by handle 22 during urine disposal permits the contaminated liquid to pass thru the weir in association with a reduced quantity of flush water from the tank as disclosed by any number of patents now on file in the U.S. Patent Office. On completion of this action the valve assumes its customary closed position with the water level in the bowl once again established at the lower level 15. Being normally closed the introduction of more water into the bowl raises the water level to the full height of the weir 14 which is done prior to a defecation. Flushing now is accomplished using a full tank of water and since valve member 8** remains closed, the fecal material is siphoned over the weir in the traditional manner.

It is important during the installation process that a seal be established and forever maintained between the fixed and insertable portions of the weir. Bolt 35 interaction with bolt holes 29 and 30 is intended to provide and maintain a firm mechanical bond between the two surfaces. Channels 21 which are semi-circular on the lower surface of partition member **6*b* also penetrate the side plates 11** permitting the insertion of a suitable caulking compound under pressure completely across the two mating surfaces assuring an airtight closure or seal.

Because it is very important that no contaminated liquid ever be permitted to leak thru the walls of the trap area I provide circumferential drain grooves 23 near the ends of the cylindrical valve member which are positioned, when assembled, within the confines of the side plates. Their positions coincide with the positioning of drain tunnels 20 such that any liquid that enters the grooves 23 is immediately drained into the sewer side of the trap. This protection is backed up by compressed teflon "O" rings 19 in recesses 24 on the ends of the cylindrical valve member 8. Since the only hydrostatic pressure that these protective techniques will see is an occasional 3" static head while the water level is temporarily raised during a defecation and the momentary splash of flowing water following a defecation flush, it does not seem likely that any leakage to the outside will occur.

While I have described my invention in certain of its preferred embodiments, I realize that modificatons may be made and I desire that it be understood that no limitations upon my invention are intended other than may be imposed by the scope of the appended claims.

I claim:

1. In a water closet having a bowl, a sewer access volume and a water trap interconnecting the bowl and sewer access volume, the water trap being defined by two side walls, the bowl rear wall and a trap wall extending between the two side walls intermediate the bowl rear wall and the sewer access volume, the improvement wherein:

(a) said trap wall includes a lower portion integral with said water closet and a separate upper portion constructed for insertion as a unit into said water closet for attachment to said integral lower portion;

(b) said water closet includes opening means in one of said side walls disposed relative to said lower portion of the trap wall so that said upper portion of said trap wall may be inserted through said opening means for attachment to said lower portion of said trap wall, means for sealing said opening means, means for providing a seal between said upper portion of said trap wall and said lower portion of said trap wall and means for providing a seal between said upper portion of said trap wall and the respective side walls of said water trap;

(c) said upper portion of said trap wall includes a first partition member and a second partition member supported in spaced relation between a pair of side plates attached to the respective opposite sides of the partition members and affixed to said lower portion of said trap wall, said partition members thereby defining, respectively, the upper and lower extremities of a passageway through said upper portion of said trap wall; and (d) said upper portion of the trap wall further includes valve means supported by said side plates intermediate said partition members for opening and closing said passageway, whereby the contents of said bowl are constrained to flow over the top of said upper portion of said trap wall for passage to said sewer access volume when said valve means is closed and permitted to flow through said passageway for passage to said sewer access volume when said valve means is open.

2. The improvement as recited in claim 1, wherein said second partition member and said side plates have cooperative channels for receiving sealing material to provide a water tight seal between said lower portion of said trap wall and said upper portion of said trap wall.

3. The improvement as recited in claim 1 wherein said opening means defines in each of said side walls, a hole adapted to receive a corresponding one of said side plates and configured substantially to conform to the periphery of that side plate.

4. The improvement as recited in claim 3, wherein said means for sealing said opening means includes gasket material disposed between the periphery of each of said holes and the periphery of the corresponding side plate and restraining ring means for compressing said gasket material.

5. The improvement as recited in claim 4, wherein said restraining ring means comprises a pair of restraining ring members attached respectively to said side plates for retaining said side plates within the corresponding holes in said side walls.

6. The improvement as recited in claim 1, wherein said valve means comprises a cylindrical valve member with its ends each supported by an opening in a corresponding one of said side plates, said valve member being rotatable about its longitudinal axis and having a flow path therethrough transverse to said axis, whereby said water trap and said sewer access volume may be interconnected through said flow path, selectively, by rotating said valve member.

7. The improvement as recited in claim 6, wherein each end of said cylindrical valve member has a circumferential groove positioned so as to locate within the opening in the corresponding side plate, said opening having a drain tunnel extending therefrom to said sewer access volume, whereby said circumferential groove and said drain tunnel cooperate to convey leakage around that end of the cylindrical valve member to said sewer access volume.

8. The improvement as recited in claim 6, wherein each end of said cylindrical valve member has an outwardly projecting shaft member which extends beyond the corresponding side plate, said shaft member being retained by an end cover plate attached to that side plate.

9. The improvement as recited in claim 8, wherein said cylindrical valve member carries means for sealing the same against said upper and lower partition members and means at each end thereof for sealing that end against its corresponding side plate.

10. The improvement as recited in claim 9, wherein said end sealing means comprises a recess about the circumference of said cylindrical valve member and a sealing ring supported by said recess, said sealing ring being held in compression against the corresponding side plate by the end cover plate attached thereto.

* * * * *